US005223660A

United States Patent [19]

Wahlgreen

[11] Patent Number: 5,223,660

[45] Date of Patent: Jun. 29, 1993

[54] PICK-UP SYSTEM FOR BRIDGE OF STRINGED MUSICAL INSTRUMENT AND MUSICAL INSTRUMENT EMPLOYING SAME

[75] Inventor: Helge Wahlgreen, Silkeborg, Denmark

[73] Assignee: Jörgen Wilson, Risskov, Denmark

[21] Appl. No.: 487,964

[22] PCT Filed: Oct. 25, 1988

[86] PCT No.: PCT/DK88/00171

§ 371 Date: Jun. 26, 1990

§ 102(e) Date: Jun. 26, 1990

[87] PCT Pub. No.: WO89/04107

PCT Pub. Date: May 5, 1989

[30] Foreign Application Priority Data

Oct. 26, 1987 [DK] Denmark ..... 5586/87

[51] Int. Cl.[5] ..... G10H 3/18

[52] U.S. Cl. ..... 84/731; 84/DIG. 24

[58] Field of Search ..... 84/730–732, 84/DIG. 24

[56] References Cited

U.S. PATENT DOCUMENTS

| | | | |
|---|---|---|---|
| 3,325,580 | 6/1967 | Barcus et al. | 84/731 |
| 4,147,084 | 4/1979 | Underwood | 84/731 |
| 4,278,000 | 7/1981 | Saito et al. | 84/DIG. 24 |
| 4,378,721 | 4/1983 | Kaneko et al. | 84/DIG. 24 |
| 4,860,625 | 8/1989 | Mathews | 84/731 |
| 4,867,027 | 9/1989 | Barbera | 84/731 |

*Primary Examiner*—Stanley J. Witkowski

*Attorney, Agent, or Firm*—Antonelli, Terry, Stout & Kraus

[57] ABSTRACT

A pick-up system for placing in connection with the bridge of a stringed instrument consisting of individual, cylindrically designed microphone units, that are inserted in bored tight-fitting holes in the bridge close to the individual strings, such that the microphones are rotatably frictionally fixed therein. The acoustic axes of the microphones are transversely oriented, whereby for individual adjustment it is possible by turning the microphones in the tight-fitting holes to adjust the angle between the individual axes and the respective directions to the strings.

10 Claims, 1 Drawing Sheet

PICK-UP SYSTEM FOR BRIDGE OF STRINGED MUSICAL INSTRUMENT AND MUSICAL INSTRUMENT EMPLOYING SAME

The present invention relates to a pick-up system for acoustic devices such as musical instruments, in particular for mounting in connection with bridges on stringed instruments. It is well known that the vibrations of strings and in instrument cases may be detected by suitable microphones or transducers with a view to an electrically amplified sound reproduction, but it is also known, that hereby a certain number of problems arise concerning correct reproduction of timbre and sound intensity relations among various local sound sources such as the individual strings of a multistring musical instrument. Incorrectly detected intensity relations may, however, be corrected by selective attenuation of the signals from the various transducers associated with the individual sound sources, but such electrical attenuation in itself implies certain problems regarding necessary attenuation equipment, noise generation and interference phenomena in a parallel connected system of transducers. As far as a correct detection and reproduction of the timbre is concerned, it is in no way given that this will be achievable by placing an otherwise excellent microphone at a presumed suitable place of the instrument, as the timbre may well be determined or codetermined by sound waves which pass through or along the relevant instrument surface portion without revealing itself outwardly to the microphone.

With the present invention it is aimed at providing a pick-up system which distinguishes itself by such placeability and adjustability that in a simple manner both a possibility of a purely acoustic attenuation of the signal to be detected and a possibility of an adjustment to an optimized reproduction of the timbre of the instrument is achievable, and according to the invention this is achieved through the pick-up system comprising one or more microphones each designed with a circular cylindrical housing for frictionally fixed rotatable reception in a mounting hole in a selected part of the musical instrument, said housing comprising a piezoelectric transducer with diametrically oriented axis.

Hereby the microphone or microphones are placeable in narrow mounting holes in a relevant part of the instrument, whereby sound vibrations can be detected which are transmitted along the relevant surface portion in some main direction therein. As the microphone is rotatably mounted in the mounting hole an optimum angular position as the directional microphone may be empirically determined, whereby a required individual attenuation of the detected signal and/or an individual correction of the detected and reproduced timbre, respectively, will be achievable.

As the transducers are mounted in cylindrical holes, they may furthermore be adjusted with respect to their penetration depth into the holes, and also hereby an attenuation and/or timbre adjustment may be effected.

According to a main embodiment of the invention a transducer is situated immediately below each of the strings of the bridge of a stringed instrument, whereby it is possible to solve the problem of getting the signals from the individual strings suitably mutually attuned without applying electrical attenuation equipment. By their close contact with the bridge in the near fields of the respective strings the transducers may produce quite heavy output signals when they are oriented in the primary sound routes from the strings down along the bridge, while the same signals may be attenuated by the said purely mechanical adjustment of the orientation and mounting depth of the transducers. In the bridge also secondary vibrations occur as reflections from the timbre box and just this renders it possible for the transducers to also detect the timbre of the instrument The mounting in the near field of the strings presents the advantage that it is predominantly the actual instrument sound that is detected while noise signals from e.g. the fingering at a fingerboard will only to a limited extent be transmitted to the transducers.

A pick-up system according to the invention can be constructed of small and very compact transducers that can be mounted in a simple manner without affecting the instrument construction and without changing the acoustic characteristics of the instrument, and also the transducers may be insensitive to outer sources of noise, among others the humming from alternating current fields and electric noise from lighting systems. The transducers may be optimized or minimized to different types of instruments according to the lowest sound frequency of the instrument and the compact transducers have been found to be able to react evenly, i.e. in a uniform manner for all frequencies. It has even been found that the reproduction of equally strong tones at pizzicating and bowing, respectively, is uniform, which otherwise is not always the case.

A preferred embodiment of the compact transducers involves use of a circular cylindrical housing formed of semi-cylindrical block parts, preferably of brass, between which at least one disc of a piezoelectric material is laid. In the disclosed form of the invention two piezoelectric discs are laid between the block parts with the two discs being glued with electrically conducting glue to an intermediary foil electrode and at their opposite outer sides being correspondingly glued to the block parts. The two block parts are mutually electrically connected through at least one end disc portion. The housing near one end of its ends is designed having a tube projecting in a radial plane and constituting both an operating handle for the housing and an outlet stub for a connecting wire to the transducer. The invention additionally comprises a musical instrument or a part of an instrument such as a string bridge which has the concerned transducers premounted.

The invention is described in further detail in the following with reference to the drawings,

DETAILED DESCRIPTION OF DISCLOSED EMBODIMENT

Figure 1:
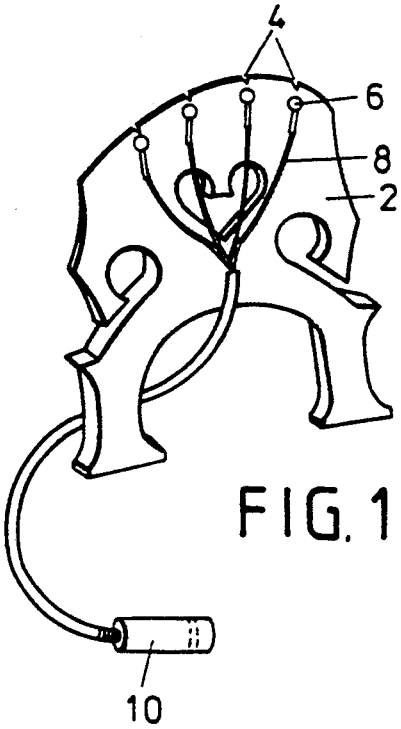
FIG. 1 is a perspective view of a bridge for a contrabass provided with a pick-up system according to the invention.

In FIG. 1 is shown a bridge 2 underneath the string incision 4 of which are situated respective transducers 6 with connecting wires 8 to a common plug 10 for connection to an amplifier. The transducers 6 are made as small rigid cylinder elements which are inserted into tight fitting holes in the bridge and each one comprises an engagement means of a non-circular shape in the form of a radially projecting tube portion 12 acting both as stub for the wire 8 and as an operating handle at the mounting and a following adjustment of the position of the transducer in the associated tight-fitting hole.

Figure 2:
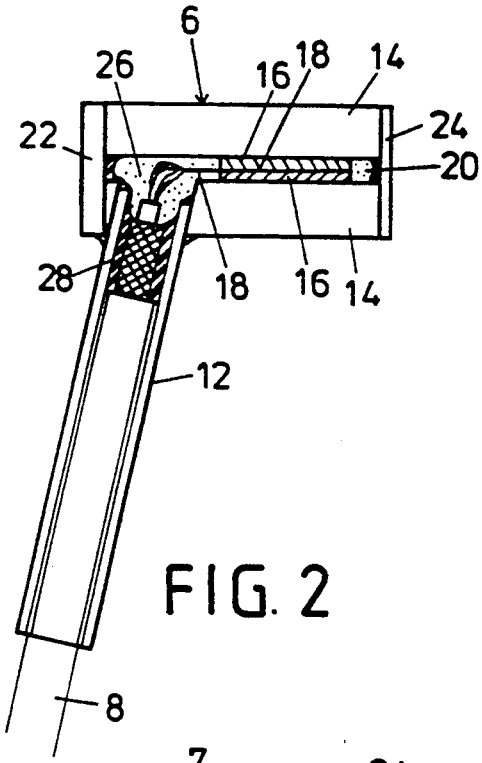
FIG. 2 is a longitudinal section through one of the transducers applied in this system.
Figure 3:
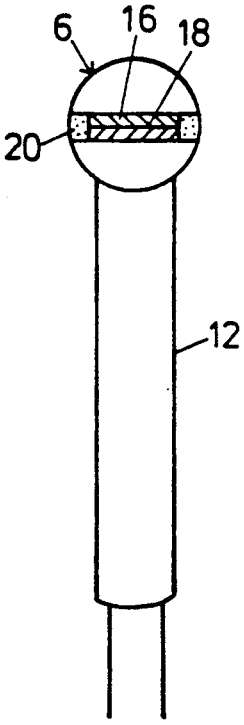
FIG. 3 is an end sectional view of the same along the line III—III in FIG. 2.

The more detailed design of the transducers is shown in FIGS. 2 and 3. The cylinder body 6 consists of two semicylindrical blocks 14, between which is placed a pair of piezoelectric crystal discs 16 which by means of an electrically conducting epoxy glue are glued to an intermediary metal foil 18 just as the outer sides of the discs 16 are conductively glue connected to the respective blocks 14. Round the edges of the discs 16 is provided an insulating compound 20, and the blocks 14 are additionally held together by means of end discs 22 and 24 that are soldered on. The intermediary foil 18 constitutes the "hot" electrode of the piezo element and is connected to the central conductor 26 in an output coaxial cable 8 the screen conductor 28 of which is connected to the metallic block system surrounding the crystal discs 16. The metal parts 14,22,24 consist preferably of brass in which the velocity of the sound is almost the same as in wood. It will be understood that the crystal discs 16 will detect the pressure variations between the block portions 14 in a direction perpendicular to the plane of the plates and that such variations will be transmitted to the transducer from the wall of the surrounding tight-fitting hole. Thus, it can be seen that the piezoelectric transducer has a diametrically oriented axis of direction sensitivity. It should be particularly noted that the foremost fixed end disc 24 of the transducer is rather thin such that it does not interlock the blocks 14 against transferring the pressure variations concerned to the crystal discs 16. This frontal disc 24 might even be dispensed with and be substituted by the hardened moulding compound 20.

The tube 12 is slightly rearwardly inclined whereby it is easily caught for turning and displacing the transducer body in the mounting hole. The holes should be made with substantial accuracy such that the transducers may be inserted with a good and friction-yielding fit without causing any essential tension in the wood.

Figure 4:
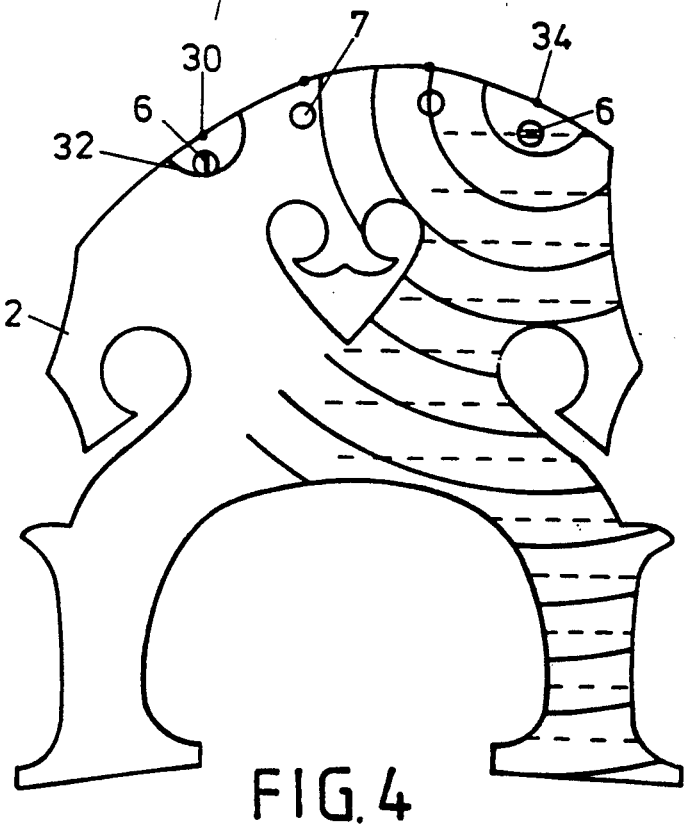
FIG. 4 is plan view of the bridge shown in FIG. 1.

In FIG. 4 is shown a just struck string 30 from which a front wave 32 propagates through the bridge 2. The associated transducer 6 is shown with its axis positioned transversely to the direction of propagation of the wave at the particular place, i.e. the transducer will reproduce the signal with appreciable attenuation. On the right is shown a sounding string 34 with an associated wave pattern in the bridge, including waves—shown in dotted lines—originating from the timbre box of the instrument. The transducer 6 referred to is here oriented with its active axial plane intersecting the strings, whereby the transducer produces a signal at full intensity; this, however, will also depend on the degree to which the transducer is inserted into the tight - fitting hole.

The area of the crystal discs 16 may as shown be approx. half the diametric area of the transducer and the disc area and thickness may be adapted such that the transducer should be able to reproduce the deepest tones of the instrument, the lower frequency limit of the transducer being determined by the crystal size. For use with a contrabass, the deepest string of which is of 41.2 Hz, a transducer having a length of 12 mm and diameter 5 mm and 30 Hz as lower frequency limit may be designed, whereas the measurements for violin transducers may be as small as 3×5 mm, viz. having a lower frequency limit of 135 Hz, which is somewhat lower than the frequency 196 Hz for the deepest string of the violin.

The upper frequency limit of the transducers may be higher than 30 kHz and they may produce a wholly linear signal between the frequency limit areas. By the said preferred design with two crystal discs the signal size is approx. 100 mV over 1 Mohm.

I claim:

1. A pick-up system for a stringed musical instrument, comprising one or more microphones each designed with a circular cylindrical housing for frictionally fixed rotatable reception in a mounting hole in a selected part of the musical instrument, said housing comprising a piezoelectric transducer with diametrically oriented axis of direction sensitivity, and engagement means of a non-circular shape being provided at or near an end of the transducer housing for facilitating rotation adjustment thereof.

2. A pick-up system according to claim 1, wherein the housing is formed of semi-cylindrical block parts between which at least one disc of a piezoelectric material is laid.

3. A pick-up system according to claim 1, wherein the housing includes two piezoelectric discs which are glued with electrically conducting glue to an intermediary foil electrode and which at their opposite outer sides are correspondingly glued to the block parts, said block parts being mutually electrically connected through at least one end disc portion.

4. A pick-up system according to claim 1, 2 or 3, wherein the housing near one of its ends is designed having a tube as said engagement means, said tube projecting in a radial plane and constituting both an operating handle for the housing and an outlet stub for a connection wire for the transducer.

5. A pick-up system according to claim 2, wherein the transducer takes up an area of the magnitude half the diametral area of the housing and the transducer is minimized for adaptation of its lower frequency limit of the deepest tone of the musical instrument.

6. A pick-up system according to claim 2, wherein said block parts are formed of brass.

7. A pick-up system according to claim 5, wherein the housing size is 5×12 mm for a contrabass.

8. A pick-up system according to claim 5, wherein the housing size is 3×5 mm for a violin.

9. A musical instrument or instrument part with a pick-up system comprising one or more microphones each designed with a circular cylindrical housing which is mounted in a tight-fitting hole in the instrument or instrument part in a frictionally fixed displaceable and rotatable manner, each housing comprising a piezoelectric transducer with diametrically oriented axis of direction sensitivity and engagement means of a non-circular shape being provided at or near an end of the transducer housing for facilitating rotation adjustment thereof.

10. The instrument or instrument part according to claim 9, further comprising a bridge for multiple strings, the respective tight-fitting holes for individual microphones being provided in the bridge immediately below a fixing point for each individual string.

* * * * *